United States Patent [19]

Bejat et al.

[11] 3,953,704

[45] Apr. 27, 1976

[54] COATING APPARATUS

[76] Inventors: Jean Bejat, 4, rue Antoine Petit, 92260 Fontenay-aux-Roses, France; Michel Braguier, 11, rue de la Planche, 75007 Paris; Roger Tueta, 40, rue Cavendish, 75019 Paris; Raoul Vistosi, 54, rue de Meaux, 93140 Bondy; Maurice Verna, 14, rue du Docteur le Thiere, 27000 Evreux; Gerard F. Aubin, 8, rue Corneille, 27000 Evreux; Christian Naturel, 9, rue Pierre de Coubertin, 27000 Evreux, all of France

[22] Filed: Apr. 5, 1974

[21] Appl. No.: 458,126

[30] Foreign Application Priority Data

Apr. 5, 1973 France ..... 73.12323

[52] U.S. Cl. ..... 219/76; 118/49.1

[51] Int. Cl.[2] ..... C23B 13/12

[58] Field of Search ..... 118/47, 49.1, 49.5; 427/34, 423; 219/76, 79, 81

[56] References Cited

UNITED STATES PATENTS

| | | | |
|---|---|---|---|
| 3,010,009 | 11/1961 | Ducati | 427/34 X |
| 3,114,826 | 12/1963 | Sullivan et al. | 219/76 |
| 3,182,361 | 5/1965 | Trimble | 118/69 X |
| 3,312,190 | 4/1967 | Bradshaw | 118/49.1 |
| 3,347,698 | 10/1967 | Ingham, Jr. | 427/34 |
| 3,741,796 | 6/1973 | Walker | 427/423 |
| 3,778,626 | 12/1973 | Robertson | 118/6 X |

*Primary Examiner*—Morris Kaplan
*Attorney, Agent, or Firm*—Abraham A. Saffitz

[57] ABSTRACT

The apparatus comprises a plasma torch capable of an output speed of at least 100 m/s, a fine powder distributor, and a substrate holder which can be heated electrically and cooled by water, which is at an adjustable distance from the torch, and which is movable in two transverse directions at adjustable speeds. The method consists in starting from ceramic having a low roughness CLA and from powder having a narrow granulometric distribution over an average value of at most 10 μm, and projecting the melted powder onto the substrates kept at a regulated temperature and subjected to the said transverse movements.

2 Claims, 1 Drawing Figure

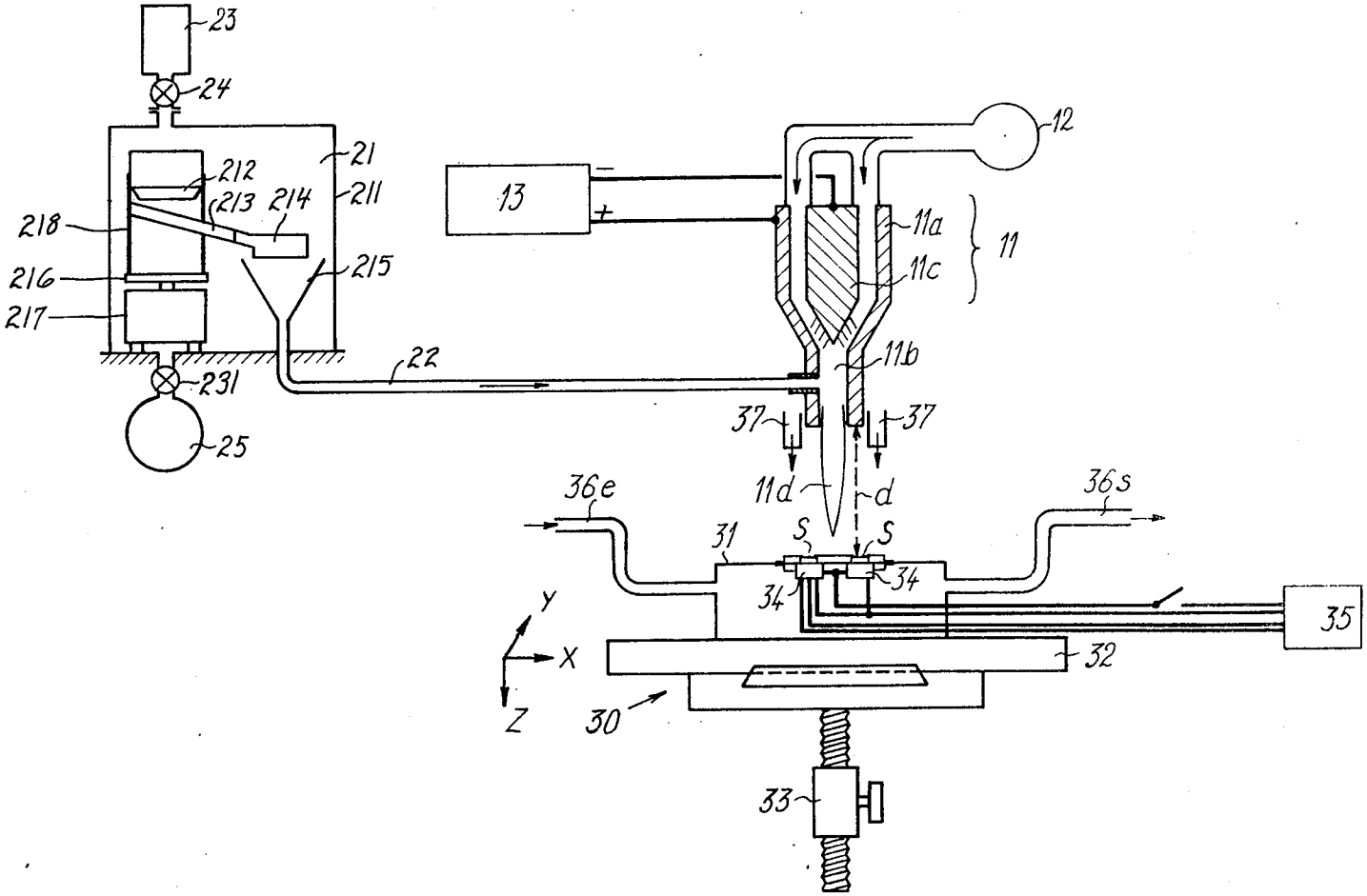
12
11
11a
11c
11b
37
d
S
34
11d
37
S
34
31
36e
36s
32
35
33
30
X
Y
Z
13
22
21
211
215
214
212
213
23
24
231
25
218
216
217

COATING APPARATUS

The present invention relates to apparatus for carrying out a method of depositing a metal or like layer onto a ceramic or like substance.

The known processes of this kind can be divided into two categories. In one, the metal is deposited under vacuum, either by heating by means of a source with a Joule effect, or by electronic or ionic bombardment, on the condition however that the ceramic is covered at the beginning with a so called fixing layer. For example in order to obtain a copper deposit of good adherence under vacuum or by electrolytic means, one commences by applying to the ceramic a layer of a mixture of molybdenum manganese and binding agent, a layer which is then subjected to annealing in a furnace at 1300°C in a hydrogen atmosphere in order to obtain the desired adhesive quality.

The known processes of this first category have the following disadvantages in common:

The necessary existance of a hanging layer has the result on the one hand of complicating the photogravure process by reason of the different behaviours of the constituents of the two layers vis-a-vis the chemically corroding agents, and on the other of significantly modifying the electric and thermal characteristics of the constituent of the "useful" layer by the very different characteristics of the hanging layer.

— the speed of depositing the metal is always relatively low (in the order of some angstroms per second (A/s) to some tens of A/s). For example the deposition of the effective layer of copper of 2 $\mu$m by means of the standard cathodic pulverisation equipment takes about 15 minutes.

In the category of the processes, the deposition of the metal (generally a noble metal) is carried out by the following sequence. First of all a compound which is generally a paste is comprised of a mixture in suitable proportions of the powder of the metal to be deposited and glass powder is applied to the ceramic by the standard serigraphical technique (across a fine meshed silk screen). This layer is then subjected to annealing in air at a generally elevated temperature; the fusion of the glass particles ensures the cohesion of the metal particles and the adherence of the layer.

The known processes of this second category have the following disadvantages in common, the relatively high annealing temperature excludes certain metals, particularly those which are easily oxidised; the electrical and thermal characteristics of the metal are again modified, here by reason of the presence of glass (which may result in an actual cut of the much weaker microstrip lines obtained by photogravure; the minimum thickness of the deposited layers cannot fall below 15 to 20 $\mu$m if a suitable reproduction is to be obtained; finally the reproducibility of the electric and thermal characteristics leaves much to be desired because on the one hand the proportions of the metal and glass mixture as well as the parameters of the annealing can vary from one production to the next and on the other hand the spreading of the paste under pressure can give rise to significant variations in the thickness of the layer which is also difficult to reproduce (the current thickness of the serigraphed layer in a single stage is from 20 to 30 $\mu$m).

The present invention aims at providing apparatus of the type defined above but which avoids all the disadvantages of the known processes by enabling the deposit to be made on the ceramic direct, that is to say without the latter separate adhesion promoting or having to be first coated with a hanging layer and starting from a single metal, i.e. without the metal having to be mixed with glass for example.

To this end the equipment according to the invention is characterised in that it comprises (*a*) a plasma torch enabling an outlet speed of the plasmagene gas of at least 100 m/s (*b*) an distributor with an adjustable delivery enabling a fine metallic powder containing hardly any agglomerates to be injected into the plasma by a carrier gas (*c*) a substrates holder whose distance from the anode outlet of the torch is adjustable, the substrates holder mounted so that it can be moved in its plane in two alternative crossed movements of adjustable speed enabling the substrates to be swept by the flame of the torch, finally provided with a device with electric heating resistances for controlling the temperature and a circulation of cooling water with adjustable flow/delivery and blowers for blowing in compressed air arranged on either side of the torch and pointed towards the substrates holder.

This equipment enagles the process to be carried out characterised in that starting from a ceramic such as alumina or beryllium oxide having a central line averable (CLA) surface roughness reduced to a few micrometers and a fine metallic power with a high degree of purity such as 99.9%, a particle size of at most 10 $\mu$m and a relatively narrow granulometric distribution defined by a ratio of extreme granular structures in the order of 3 to 4, the metal is deposited on the ceramic by mounting the substrates holder at a set distance from the anode output of the torch, by maintaining it at a specific controlled temperature and by introducing the said alternative crossed movements at speeds which are likewise set, all the parameters adapted to the kind and granulometry of the metallic powder to be deposited, all whilst maintaining a circulation of cooling air and/or blowing in of compressed air.

Whilst in known processes of the first category seen above, the impact speeds of the particles remain in the order of some m/s, the use of a plasma torch enables the melted particles to be projected at speeds in the order of a few hundred m/s. As they strike the surface of the ceramic, these particles which are carried in the fluid state are deformed and anchor on the micro roughened parts of this surface and this is all the better since the ceramic is maintained at a certain temperature.

The invention will be better understood from the following description of one embodiment of coating apparatus, given by way of example only, with reference to the accompanying drawings whose single figure is a diagram of this apparatus.

A torch 11 receives from a source 12 a plasmagenic gas (for example helium, argon, hydrogen, nitrogen, or a mixture of at least two of these gases). The most often used gas is argon; it can be supplemented with helium if it is desired to increase the temperature of the flame without adding reactive elements, or with hydrogen if the flame is to form a reducing atmosphere. The torch is connected to a d.c. generator 13 which ensures the formation of an arc between the two electrodes (anode 11*a* and cathode 11*c*). At its outlet, in a projection chamber 11*b* the torch receives a fine powder which serves to form the coating and is propelled by a carrier gas (usually argon).

The mixture of powder and gas is carried in the fluidized state from and adjustable delivery distributor 21 into the projection chamber 11*b* by means of a duct 22. The distributor 21 comprises a tightly sealed cylindrica enclosure 211 in the top wall of which there is provided an adjustable valve 24, by means of which the enclosure 211 communicates with a powder tight container 23. In the enclosure 211, below the valve 24, is placed a sieve 212 below which is provided an inclined spout 213 having the lower end thereof in open relation on the sieve 214 rigidly fixed on said spout 213. The sieve 214 is about a funnel 215, which is connected to the duct 22. The sieve 212 and the spout 213 are rigidly fixed, by means of brackets 218, on to the vibrating plate 216 of a mechanical vibrator means 217, which aids the powder flow and delivery by the distributor. The enclosure 211 communicates with a source of argon 25, said source being for instance a bottle of pressurized argon provided with an escape valve 231, which is adjusted for maintaining a slight excess pressure in the enclosure 211. The vibrating movement imparted to the sieves 212 and 214 and to the spout 213 causes the steady flow of the powder delivered by the valve 24 into the funnel 215, in to which blows the gas current from the pressurized argon source. Consequently, a homogeneous fluidized mixture of said powder and said gas is carried by the duct 22.

Finally, downstream of the flame 11*d* is mounted a substrate holder 30 which basically comprises a hollow copper block 31 set up as follows:

— the block 31 is fixed to a table 32 movable in mutually transverse directions and at adjustable speeds by a pneumatic jack (direction X) and an oleo-pneumatic jack (direction Y) neither of which are shown; this table 32 is also provided with a device 33 for adjusting in the direction Z the distance *d* between the end of the anode 11*a* and the substrates S;

— the block 31 is provided with small, low inertia heating devices comprising heating resistances 34 (one per substrate, so that heating is localised) and at least one thermocouple, the resistances and thermocouple being connected to a supply control assembly 35;

— the block 31 is also provided with a circulation of cooling water with a constant adjustable flow (of which only the inlet 36*e* and outlet 36*s* are shown);

— finally two small compressed air blowers 37 flanking the anode are directed towards the substrate holder in order to ensure superficial cooling of the substrates as soon as they leave the impact zone.

The small heating devices are preferably located in small blocks of zircon which form heat shields (not shown).

The following is a method for operation which has given good results when depositing copper on a ceramic substrate:

— place the substrates on the substrate holder 30 and heat them to the working temperature (150° to 200°C).

— add the metal powder to the distributor and set the control thereof;

— set the substrate holder 30 in motion;

— heat the torch and set the control therefor;

— inject the powder into the projection chamber 11*b* after starting up the cooling water circulation;

— carry out the deposition process for 1 minute while maintaining the supply to the small heaters;

— after cutting off the heaters and starting up the blowers 37, continue deposition until the desired thickness of coating is obtained;

— finally anneal the metallised substrate, in a hydrogen atmosphere, in order to reduce the oxides formed during projection and in order to frit the coating, i.e. to reduce its degree of porosity.

EXAMPLE:

Copper deposits of 50 μm thickness were made on alumina or beryllium oxide having a roughness CLA of 0.1 to 1.8 μm.

The performances achieved were as follows:

| | |
|---|---|
| depositing time (50 μm) | 8 min |
| degree of porosity of the copper layer | 5% |
| adherence(on the surface with roughness CLA 0.5 μm) | 50 kgp/cm² |
| resistivity | $3.10^{-6}$ ohm cm |
| (to be compared with that of solid copper of 1.7 $10^{-6}$ ohm cm) | |
| possible range of thickness from a few μm to some hundred μm. | |
| Photogravure: | |
| rate(speed) of attack (comparable to that of solid copper) 3 μm/min | |
| definition of the line | ± 1 μm |
| minimum width of the patterns | 20 μm |

The advantages gained from the process according to the invention are numerous and varied; possibility of working in the ambient atmosphere, hanging layer not required; — notable increase in the speed at which the deposit grows; deposit comprised of pure metal, thus having higher electrical and thermal characteristics, more particularly in resistivity; lower degree of porosity, in comparison with those resulting from the known processes; better adherence to the ceramic, providing the possibility of polishing or simply grinding down; extension of the number of metals which can be deposited as well as of the range of possible widths; — simplification of the photogravure and better definition of the geometrical patterns; — possibility of significantly increasing the deposit surface — better reproduction from all points of view.

Obviously the invention is not limited to the examples described and illustrated but it is capable of numerous variations open to one skilled in the art and without departing from the scope of the invention.

Thus it can be applied:

— not only to pure metals which enable conductive layers to be formed;

— but also to metals and alloys which can provide electrically resistant layers (chromium nickel);

— to metals and/or metals and oxides in superposed layers; — to mixtures of metal and oxides (cermets).

We claim:

1. Apparatus for depositing a fluidized metal layer on a ceramic substrate, comprising:

a plasma torch having a cathode, anode and an arc therebetween at its outlet and a source of plasmagenic gas at its inlet selected from the group consisting of helium, argon, hydrogen, nitrogen, and mixtures enabling an outlet speed of plasmagenic gas of at least 100 m/s;

a source of powdered metal;

an adjustable delivery distributor fed from a plasmagenic gas source enabling a fine metallic powder from said powder metal source containing hardly any agglomerates to be injected into the plasmagenic gas by said plasmagenic gas acting as a fluidizing carried gas;

said distributor fitted with a sieve, spout, vibrating means, and delivery duct;

an adjustable substrate holder means, whose distance from the anode at the outlet of the torch is adjustable;

means to move the substrate holder means in a first direction;

means to move the substrate holder means in a second direction transverse to the first direction;

mounting means for the substrate holder means;

the substrate holder means being mounted for movement in said two mutually transverse directions to that the substrate is swept by the plasma flame of the torch;

resistance heating means in thermal contact with said substrate holding means for controlling the temperature of the substrate;

means adjacent the anode of said plasma torch for blowing air onto the substrate; and, circulating liquid cooling means in said substrate holder means for cooling the substrate.

2. Apparatus as claimed in claim 1 wherein said substrate holder means comprises a hollow metal block and said mounting means comprises a table fitted with pneumatic jacks for movement in the X direction and in the Y direction.

* * * * *

UNITED STATES PATENT OFFICE

CERTIFICATE OF CORRECTION

PATENT NO. : 3,953,704

DATED : April 27, 1976

INVENTOR(S) : JEAN BEJAT ET AL

It is certified that error appears in the above-identified patent and that said Letters Patent are hereby corrected as shown below:

Assignees: ETAT FRANCAIS represented by the Ministry of Posts and Telecommunications (Centre National d'Etudes des Telecommunications), Issy-Les-Moulineaux, France Societe Desmarquest et C.E.C., Montrouge, France Signed and Sealed this Tenth Day of August 1976

[SEAL]

*Attest:*

RUTH C. MASON
*Attesting Officer*

C. MARSHALL DANN
*Commissioner of Patents and Trademarks*